US012540382B2

(12) United States Patent
Pizzuto et al.

(10) Patent No.: US 12,540,382 B2
(45) Date of Patent: Feb. 3, 2026

(54) DEVICE FOR COOLING A METAL STRIP WITH A HOT DIP COATING OF HIGH THICKNESS

(71) Applicant: John Cockerill S.A., Seraing (BE)

(72) Inventors: Fabian Pizzuto, Saint-Nicolas (BE); Michel Dubois, Boncelles (BE); Giuseppe Lombardo, Seraing (BE)

(73) Assignee: JOHN COCKERILL S.A., Seraing (BE)

( * ) Notice: Subject to any disclaimer, the term of this patent is extended or adjusted under 35 U.S.C. 154(b) by 188 days.

(21) Appl. No.: 18/681,097

(22) PCT Filed: Mar. 24, 2022

(86) PCT No.: PCT/EP2022/057748

§ 371 (c)(1),
(2) Date: Feb. 5, 2024

(87) PCT Pub. No.: WO2023/011767

PCT Pub. Date: Feb. 9, 2023

(65) Prior Publication Data

US 2024/0271264 A1 Aug. 15, 2024

(30) Foreign Application Priority Data

Aug. 6, 2021 (EP) ..... 21190098

(51) Int. Cl.

| | |
|---|---|
| ***C23C 2/20*** | (2006.01) |
| ***C23C 2/00*** | (2006.01) |
| ***C23C 2/28*** | (2006.01) |

(52) U.S. Cl.
CPC ..... *C23C 2/20* (2013.01); *C23C 2/003* (2013.01); *C23C 2/29* (2022.08)

(58) Field of Classification Search
None
See application file for complete search history.

(56) References Cited

U.S. PATENT DOCUMENTS

2008/0206592 A1 8/2008 Kim et al.

FOREIGN PATENT DOCUMENTS

| | | | |
|---|---|---|---|
| JP | 2000096202 A | * | 4/2000 |
| KR | 20110064506 A | | 6/2011 |
| KR | 102004971 B1 | | 10/2019 |

* cited by examiner

*Primary Examiner* — Alexander M Weddle
(74) *Attorney, Agent, or Firm* — LEYDIG, VOIT & MAYER, LTD.

(57) ABSTRACT

An installation for adjusting a thickness of a hot liquid coating on a traveling strip with suppression of "angel wing" flow defects, the traveling strip having a thickness equal to or greater than 2 mm, and for cooling the coating, the coating thickness being in a range above 25 μm, the installation successively include, from a bottom upwards, on either side of the traveling strip: a wiping device having gas knives for wiping excess liquid from the coated strip at an outlet of a liquid bath; at least one conventional gas cooling header with gas blowers for solidifying the coating; and a water cooling and freezing header for producing airless spraying of demineralized water for skin freezing of the coating, the header being located as close as possible to the wiping device and between the wiping device and the at least one conventional gas cooling header.

20 Claims, 4 Drawing Sheets

DEVICE FOR COOLING A METAL STRIP WITH A HOT DIP COATING OF HIGH THICKNESS

CROSS-REFERENCE TO PRIOR APPLICATIONS

This application is a U.S. National Phase application under 35 U.S.C. § 371 of International Application No. PCT/EP2022/057748, filed on Mar. 24, 2022, and claims benefit to European Patent Application No. EP 21190098.0, filed on Aug. 6, 2021. The International Application was published in English on Feb. 9, 2023 as WO/2023/011767 under PCT Article 21(2).

FIELD

The present invention relates to a device for cooling the coated surface of a traveling strip, preferably a coated metal strip at the outlet of a liquid metal bath. The invention particularly relates to a device intended to "freeze" the liquid skin of a thick coating laid on a relatively "thick" metal strip (thickness>2 mm), just after wiping, while avoiding complete solidification of the coating, especially in case of coatings with a thickness greater than 25-30 microns. In this context, "freeze" shall be understood as selectively solidifying the skin (external) layer of the coating, at the exclusion of the bulk layer thereof.

BACKGROUND

Driven by the market of galvanized steel sheets for extended corrosion protection, steel producers are requiring increased zinc coating layer thickness, preferably above 25 microns and up to about 60 microns, while a standard zinc coating layer is typically between 7 to 20 microns.

The market is also asking for products without a defect called spangle which appears as the molten zinc coating on the galvanized steel begins to cool below the melting point of zinc (419° C.). It is known that, for avoiding such defects, the molten zinc bath composition should be Pb and/or Sb-free As shown in FIG. 1, it is well-known that hot dip galvanized zinc coating is controlled through deflecting the strip 2 around a sink roll 11 at a certain speed and further wiping off excess zinc through gas nozzles 5 at the exit of the bath 10. Blowers put the gas under a controlled pressure between 50 to 800 mbars. Gas is uniformized through and inside a chamber and exits the nozzles 5 at a certain speed. The gas in contact with the strip wipes off the excess zinc, that trickles downward by gravity, and leaves on the steel surface only the desired zinc quantity. The zinc coating consists of several layers including an intermetallic layer, enhancing the adherence. The intermetallic layer thickness is relatively constant with respect of the total coating thickness. It is then much smaller proportionally for a high coating thickness compared to a low coating thickness. Wiping parameters are correlated and if one parameter such as the strip speed is changed, another parameter, such as the wiping pressure shall change to keep the same coating thickness. Depending on gas speed, coating thickness and other process parameters, the strip surface aspect may be changing. Standards exist for final product quality qualification based on surface appearance and uniformity of zinc coating thickness. When the zinc coating thickness is below a minimum requirement, the product is rejected.

After wiping, the coating is usually cooled through forced air cooling 4 in an upward cooling tower before being deflected at a top roll 12 and further cooled by forced air cooling and/or water cooling 4'. Between the nozzles and the first cooler, natural cooling takes place. The heavier the coating weight and the thicker the strip, that means a strip with a thickness over 2 mm, the longer the cooling required. The cooling speed by the forced air cooler 4 shall be adjusted according to the solidification state of the coating. Specifically, when the surface of the coating is still liquid, forced cooling must be limited. Water trapped inside liquid zinc can burst due to its transformation to gaseous form and this may lead to safety issue.

When the coating thickness increases at values typically higher than 25 microns, and due to the fact that it takes a certain time between the coating adjustment and solidification, the coating tends to flow downward under the gravity and also owing to its low viscosity. Because of the existence of a significant time between coating adjustment and solidification, the length along which the coating can flow becomes high. The thicker the coating, the longer will be the flowing length. This gravity-caused flow defect is also called "angel wing".

The inventors have computed that the mass of the liquid flowing down varies with the cubic power of the coating thickness. In some situations, this flow downward is disturbed either by the oxide formed on the surface of the liquid or by the roughness of the substrates or finally by intermetallic particles that are inevitably entrained by the strip going out of the coating pot. Therefore, according to prior art methods, the coating becomes non-uniform and strong waves are formed.

Very strangely, the inventors have found that the disturbance on the down flow and so the attached coating thickness non-uniformity is more pronounced close to the strip edges and that the attached defects, looking like drips, most usually form an angle of about 45° with the running direction of the strip (see FIG. 2). A problem is that, in addition to the poor aspect obtained, the local coating thickness varies very strongly with areas as thin as 5 to 10 μm while the average is over 40 μm, reducing then the long term corrosion resistance. There is thus a real interest in finding a solution to obtain a quality coating (without flow defects) for such thicknesses greater than 25 microns on a metal strip having a thickness over 2 mm.

Document KR20110064506A discloses a device and method for manufacturing a zero spangle of a Zn—Al alloy hot-dip plated steel sheet that are provided to prevent spangle difference due to the cooling difference of a transition surface using a magnetic strip stabilizing unit when mist is sprayed. The water supply pipe is connected to the spraying nozzle in order to supply water to the spraying nozzle. The air supply pipe is connected to the spraying nozzle in order to supply air to the spraying nozzle. The water control valve is installed on the water supply pipe and controls the amount of water to be supplied to the spraying nozzle. This application refers to cooling in the tower to improve the cooling rate especially on a thick strip. The control of solidification and/or the viscosity of the coating when cooling is not the target. It uses a mixture or air and water at the nozzles. In addition devices must be implemented to avoid that water droplets fall down due to gravity. In this document the amount of coating is adjusted at a thickness of 14 μm.

Document KR102004971B1 has the objective of providing a method and an apparatus for manufacturing a hot-dip galvanized steel sheet which efficiently cool a plating layer in a manufacturing process of a hot-dip steel sheet to stably obtain a hot-dip galvanized steel sheet with an elegant surface without fitting defects, drop mark defects, and linear Moiré fringe defects. The apparatus for manufacturing a hot-dip galvanized steel sheet comprises a plating port, a gas wiping device, and a cooling chamber. The cooling chamber is vertically driven by a cooling chamber driving device, and includes an ionic wind generation device generating ionic wind and a spray unit spraying a solution. In this document the amount of coating is adjusted at a thickness of 20 μm.

The purpose is to control the grain size and especially the spangle size. It targets a coating thickness below 20 μm and has the purpose to remove the spangles that appear during solidification. The system is using a propellant such air, under electrical field acceleration, which is a technology quite difficult to implement in coating lines Both technologies above are dedicated either to control the solidification and/or improve the total cooling rate in the tower

SUMMARY

In an embodiment, the present invention provides an installation for adjusting a thickness of a hot liquid coating on a traveling strip with suppression of "angel wing" flow defects, the traveling strip having a thickness equal to or greater than 2 mm, and for cooling the coating, the coating thickness being in a range above 25 μm, the installation successively comprising, from a bottom upwards, on either side of the traveling strip: a wiping device comprising gas knives configured to wipe excess liquid from the coated strip at an outlet of a liquid bath: at least one conventional gas cooling header with gas blowers configured to solidify the coating; and a water cooling and freezing header configured to produce airless spraying of demineralized water for skin freezing of the coating, the header being located as close as possible to the wiping device and between the wiping device and the at least one conventional gas cooling header, the water cooling and freezing header comprising one or more spraying nozzles, the one or more spraying nozzles being at a distance of between 50 and 300 mm from the traveling strip in use, the water cooling and freezing header being configured to spray water droplets with a size between 50 and 500 μm, with a water flow at a pressure of between 2 and 5 bar being between 0.1 and 5 $m^3/h$, so as to increase a viscosity of an external surface or skin of the liquid coating, and not an entire bulk thickness thereof, before coating solidification is completed in the at least one conventional gas cooling header.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
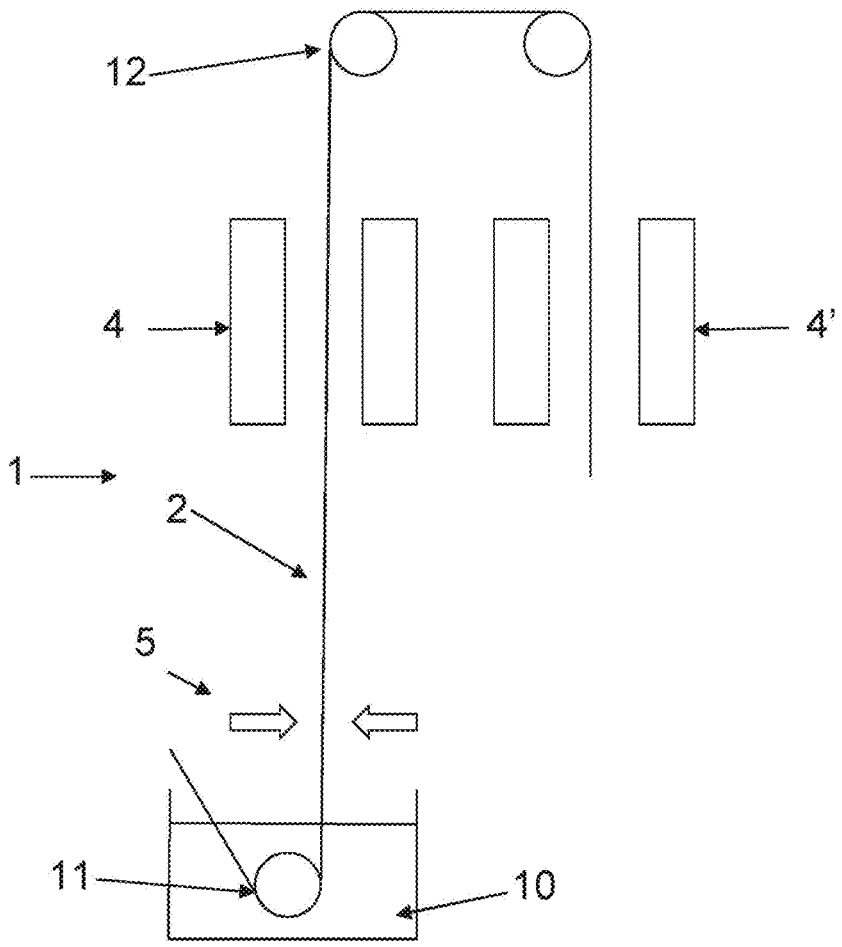
FIG. 1 (PRIOR ART)
FIG. 1 schematically represents a prior art coating installation with a wiping device, and at least a forced air cooling device.
Figure 2:
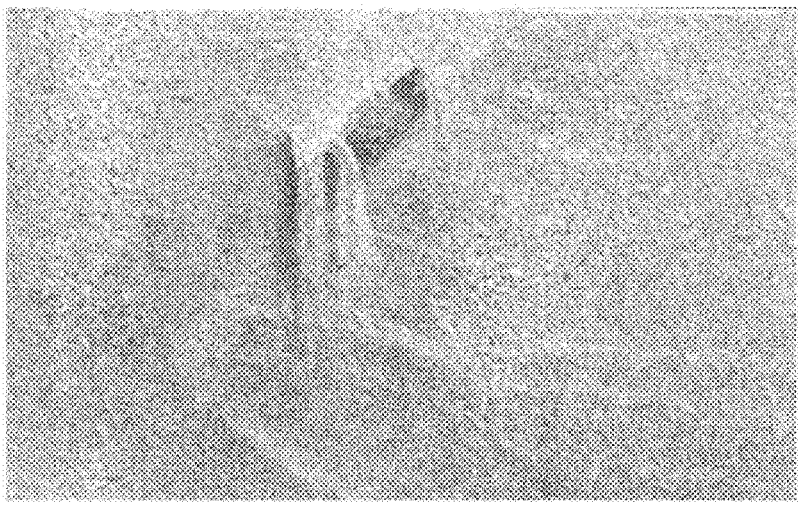
FIG. 2 (PRIOR ART)
FIG. 2 shows pictures of a defect type observed in a thick coating on a thick strip, when the coating is obtained with the techniques of prior art.
Figure 2:
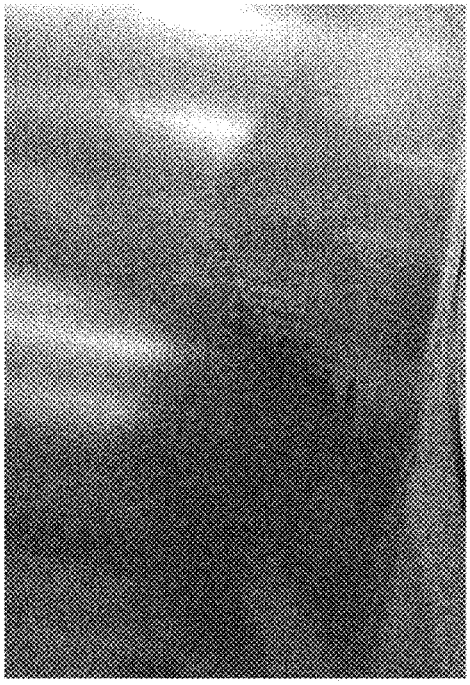
FIG. 2 (PRIOR ART)

A problem solved in the present invention is totally different from those addressed by the above-mentioned technologies of prior art because it addresses quality of a coating not making spangles due to well-chosen specific pot composition but also of a coating which is much thicker. The present invention does not therefore target the total solidification of the coating as targeted above.

In an embodiment, the present invention provides a cooling device preferably used as close as possible to the wiping device, allowing to "freeze" the skin or external surface of a coating while avoiding the complete solidification of this coating.

A purpose of the invention is to freeze the surface of the coating quickly while avoiding its full solidification in order to avoid wave effects and further flow defects such as "angel wing" defects for example, when high thickness of coating is applied on a strip, especially with a thickness greater than 25-30 microns.

In an embodiment, the invention deals with a cooling method that only uses water spray without addition of air in the nozzle or some electrical device as proposed by the prior art technologies.

In an embodiment, the invention allows to obtain an improved coating uniformity of the traveling strip, due to the freezing of the skin of the coating after the wiping by local change of its viscosity, and before performing the complete solidification for example by forced cooling. The solidification of the skin of the coating would then be performed without damaging the coating surface.

The present invention firstly relates to an installation for adjusting the thickness of a hot liquid coating on a traveling metal strip without flow defects due to thick coating, said traveling strip having a thickness equal to or higher than 2 mm, and for cooling said coating, the coating thickness being in a range above 25 μm, said traveling strip being preferably a metal strip dip-coated in a bath of liquid metal, said installation successively comprising, from the bottom upwards, on either side of the traveling strip in use, a wiping device comprising gas knives for wiping excess liquid from the coated strip at the outlet of a liquid bath and at least one conventional gas cooling header with gas blowers for completely solidifying said coating, wherein a water cooling and freezing header producing spraying of demineralized water, without air addition (airless spraying), for skin freezing of said coating is located on the strip path as close as possible of the wiping device and between the wiping device and the conventional gas cooling header, said water cooling and freezing header comprising one or more spraying nozzles, the spraying nozzles being at a distance between 50 and 300 mm from the traveling strip in use, the water cooling and freezing header being configured to spray water droplets with size between 50 and 500 μm, with a water flow at a pressure between 2 and 5 bar being between 0.1 and 5 $m^3/h$, to give the droplets hitting the coated strip sufficient impulse without need of another accelerating device such as electrostatic or similar device, so as to increase the viscosity of an external surface or skin of the liquid coating, and not the entire bulk thickness thereof, before coating solidification is completed in the gas cooling header containing gas blowers.

The said increase of viscosity contributes to erase the small pits induced by the droplet flow and thus to "self-repair" of the coating.

According to preferred embodiments of the invention, the installation is further limited by one of the following features or by a suitable combination thereof:

- the nozzles are provided on at least one transverse ramp;
- the water cooling and freezing header is configured to spray water droplets in the size range between 100 and 300 μm;
- the spraying nozzles are at a distance between 100 and 200 mm from the strip in use;
- the water cooling and freezing header is configured to deliver a water flow at a pressure between 2 and 5 bar between 0.1 and 1 $m^3/h$ per meter of strip width;
- the water cooling and freezing header is configured to deliver a water flow that is adjusted with the strip width;
- the excess of water sprayed on the liquid coating is collected by mechanical collectors located at the top and/or the bottom of the water cooling header;
- the length of the water cooling header is smaller than two meters and preferably is about one meter;
- the water cooling header is configured so that the nozzles are distributed in use along the whole width of the strip;
- the water cooling header has a casing made of stainless steel and provided with hoses and fast connections resisting to hot conditions;
- the water cooling header is located between 1 and 3 meters after the gas knives of the wiping device;
- the water cooling and freezing header is a box capable to slide according to a common vertical movement of approximately 1500 mm to adapt the position of the water cooling header to the exact desired distance from the air knives of the wiping device during process;
- the spraying nozzles are overlapping flat nozzles.

The present invention also relates to a coating control process for adjusting the thickness of a hot liquid coating on a traveling strip, and for cooling said coating, said traveling strip being preferably a metal strip dip-coated in a bath of liquid metal, using the installation described herein, comprising the following successive steps:

- blowing a gas with the wiping device onto the surface of the traveling strip coated with the liquid coating so as to adjust the coating thickness to values comprised between 25 μm and 60 μm;
- airless spraying droplets of water with the liquid cooling header onto said surface of a traveling strip having a liquid coating with a controlled thickness comprised between 25 μm and 60 μm, so as to increase the viscosity of the external surface or skin of the liquid coating, and not the entire bulk thickness thereof;
- passing thereafter the coated travelling strip in at least one gas cooling header containing gas blowers, so as to perform complete solidification of the coating through its thickness;
- wherein the size of the sprayed water droplets is between 50 and 500 μm, preferably between 100 and 300 μm; and
- wherein the water flow at a pressure between 2 and 5 bar is between 0.1 and 5 $m^3/h$, preferably between 0.1 to 1 $m^3/h$ per meter of width of metal strip, the spraying nozzles being at a distance between 50 and 300 mm, and preferably between 100 and 200 mm, from the strip.

According to preferred embodiments of the invention, the coating control process is further limited by one of the following features or by a suitable combination thereof:

- the water cooling header provides a demineralized water flow adjusted according to the strip speed and/or other process parameters;
- the coating having a thickness between 15 and 60 μm is made of Pb- and Sb-free zinc-aluminium alloy optionally containing Sn, Mg, Fe, and containing inevitable impurities.

In the drawings above, the metal strip is travelling in a plane perpendicular to the plane of the figure.

After detailed simulations and analyses, the inventors discovered that the problem of non-uniformity of thick coatings was due to the long time elapsed between the thickness adjustment and solidification of the coating as explained above. Usually, the strip passes firstly through a wiping device for the coating adjustment, and secondly through a forced cooling device, such as gas blowing device for example, for cooling and solidifying of the coating. The coating tends then to flow down under the gravity and also due to its low viscosity.

For example, with a zinc coating, the wiping process is usually done at 460° C., whereas it is well-known that full solidification occurs at 420° C. The inventors have observed that in the classical industrial process where cooling is done by natural convection, a typical time to solidification of a 2 mm strip with is about 12 to 14 seconds and, as expected, double when the strip is 4 mm thick. This cooling rate is even much faster that what would be predicted by the well-known natural convection coefficient and this is most probably due to the fact that the strip is running.

According to the present invention, in a first step, the coating is frozen on its external surface and, in a second step, cooled and it is usually done with the conventional technology to make full solidification of the coating. Concretely, the first step is performed by water spraying, preferably under the form of demineralized water, and consists in "freezing" as explained above. The second step is performed by classical air blowing in order to make the strip coating solidification as well as final cooling. Device 1 of the present invention advantageously allows to freeze the coating quickly in order to avoid wave effects and defects when high thickness of coating is applied on the strip. Also, it allows to use forced cooling at an earlier stage in the cooling process and thus prevents non uniform movement of coating along the width.

Figure 3:
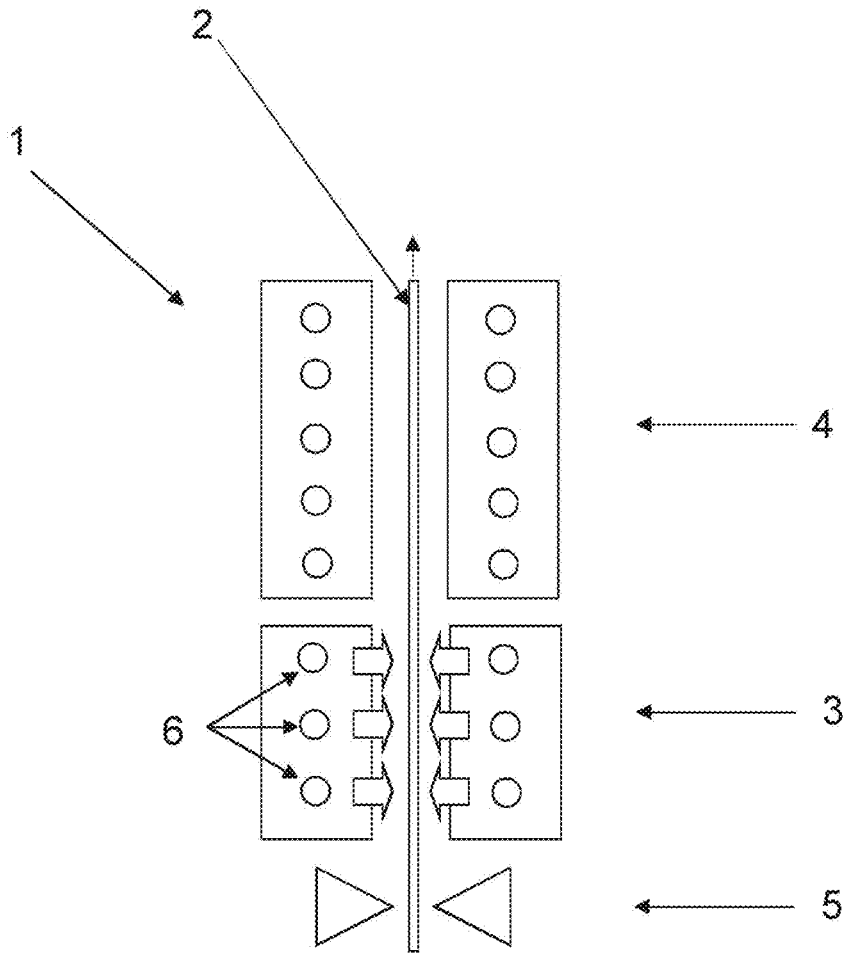
FIG. 3 schematically represents a coating installation according to the present invention in which a water spray device has been intercalated between the wiping nozzles and the forced air cooling device.
Figure 4:
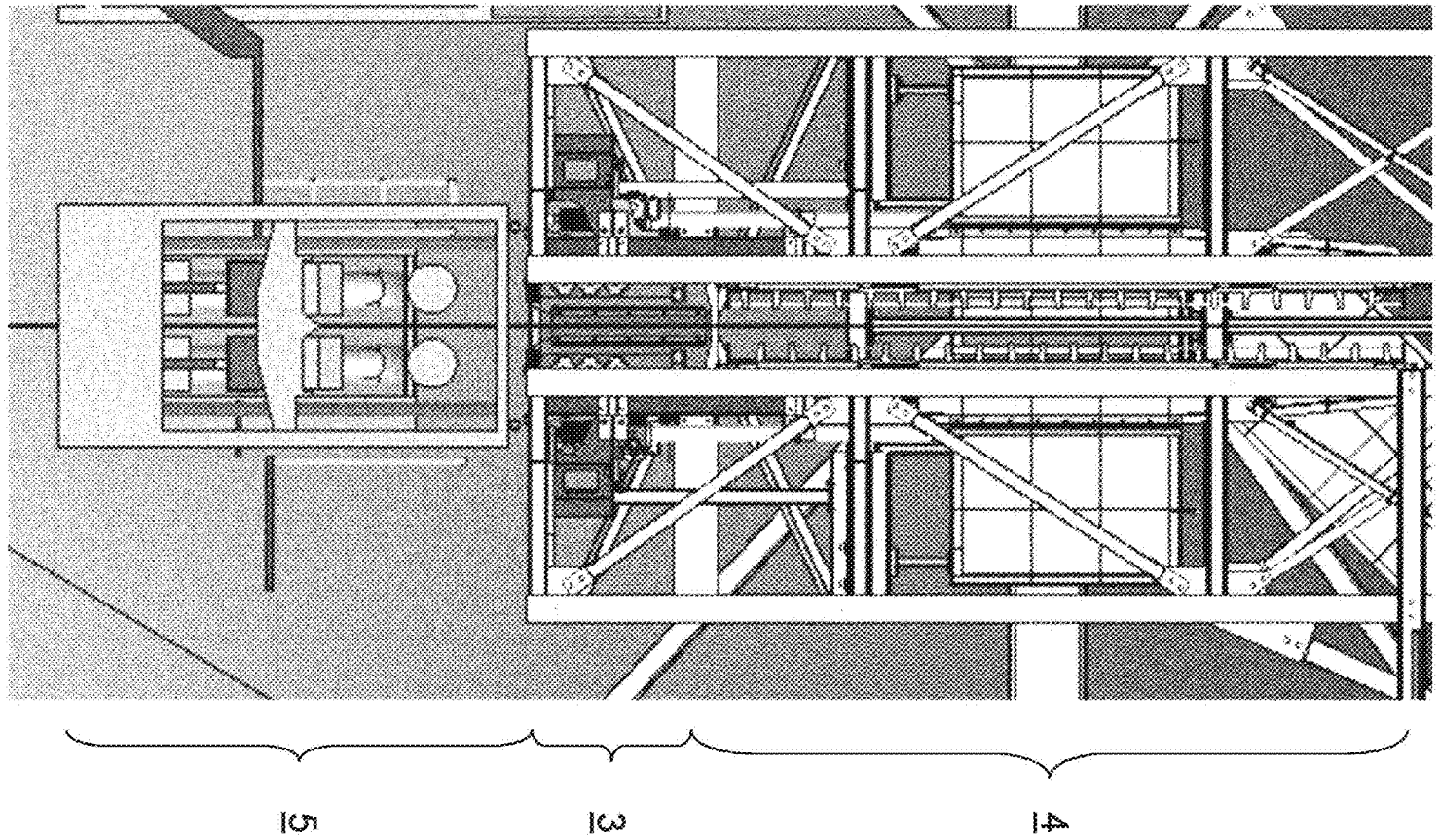
FIG. 4 represents a realistic embodiment of a water spraying device intended to spray water on the traveling strip according to the present invention.

The present invention intends to avoid the above-mentioned non-uniformity in case of thick coatings. To this end, and as illustrated in FIGS. 3 and 4, the invention relates to a system 1 that "freezes" the surface of the strip 2, by using water sprays 6 directed towards the liquid coating, just after the coating adjustment by wiping nozzles and preferably 1 to 3 meters after the air knifes of a wiping device 5. The essence of the invention lies in the fact that it is only the external surface of the coating (or said otherwise, the skin of the coating) which is "frozen", and not the whole bulk of the solidified coating. The device of the present invention thus allows a pre-cooling, that is an intermediate step in order to selectively harden the outer surface of the coating and not the entire thickness of the coating layer.

The inventors have also observed that the freezing of the surface cannot be obtained by simple air cooling because, given the required heat transfer coefficient, it would be needed to blow the cooling gas so strongly that this would damage the liquid coating. There is then a risk of explosion or craters.

The inventors have also found that mixture or air and water at the nozzle, in addition to complexity of the system, does not allow to reach the objective due to improper size of the droplets as well as the amount of water required. Similarly, using electrostatic acceleration of the droplets is not effective in that process because of the thick coating and the impulse required to be given to the droplets.

The device 1 according to the present invention comprises a water spraying device 3 without addition of air, having a plurality of nozzles 6, provided in a casing or plenum or header supplied with water.

According to one embodiment, the water cooling system 3 comprises several ramps located inside a header. Two headers are provided in the water spraying system 3 and located at equal distance on either side of the strip 2. Each ramp is equipped with specific nozzles 6, for example attached approximately every 100 mm and fed with demineralized water. The inventors found out that the mixture of entrained air and water inside the header located right above the wiping causes the solidification of the skin of the coating to be performed without damaging the coating surface. Only water is supplied by the nozzles, but ambient air is entrained by the droplets of water, and takes part to the freezing effect.

According to some embodiments, the excess of water sprayed on the liquid metal and that inevitably escapes is collected by specific devices located at the top and bottom of the water cooling system 3. As all the sprayed water is not vaporized, dedicated collectors are implemented to collect most of the residual liquid water. The collecting system is preferably based on mechanical devices, such as grids and baffle plates, plates, honeycombs, perforated sheets or similar, instead of vacuum systems that are never easy to adjust properly. For example, pans can be located under the header 3 in order to collect the overflow of demineralized water. This overflow is then rejected to the waste water system. A dedicated device can be also be located on the upper part of the header 3 in order to limit the quantity of water/vapor going outside of the casing due to the spraying on the strip 2. The demineralized water flow can also be adjusted depending of the strip speed and process requests.

According to a preferred embodiment, the water spraying device 3 and the lower air cooling system 4 (or the air cooling system which is the closest to the water spraying device 3) are mechanically connected to each other. This allows providing a common vertical movement of approximately 1500 mm for example. The purpose of this vertical movement is to adapt the position of the water spraying device 1 to the exact position of the air knives of the wiping device 5 during process. Further, water cooling system 3 is implemented in a box or header preferably made of stainless steel that can be adjusted more or less close to the wiping system 5, possibly on demand during production. This box is provided with special accessories, such as hoses and fast connections resisting to hot areas and allowing an easy connection by an operator.

The inventors have also found that the amount of water to be used cannot be too high and there is an optimized droplet size to avoid the formation of pits in the coating. The size of the droplets, very important to avoid defects on the coating, has to be adapted in function of different parameters (distance between the water nozzles and the strip, type of coating, line speed, etc.). The water flow at a pressure comprised between 2 and 5 bar is advantageously between 0.2 and 5 $m^3/h$ depending on the strip width and line speed, and still preferably between 0.3 and 1 $m^3/h$ for a 1500 mm strip width and with droplet size between 50 and 500 μm, and still preferably between 100 and 300 μm. Preferably, the water cooling system has a water consumption in the range of 0.1 to 1 $m^3/h$ per meter of width of steel sheet.

Preferably, the water cooling header has a length smaller than two meters and preferably close to one meter as the objective is not to solidify the coating totally but only to freeze its surface.

In the embodiments of the present invention, the nozzles 6 are preferably distributed along all the width of the strip 2 in which the air water mixture is made.

Preferably, the coating is made of Pb- and Sb-free zinc-aluminium alloy containing optionally Sn, Mg. Fe and inevitable impurities, and has a thickness between 15 and 60 μm.

Preferably, the water temperature is set between room temperature and 90° C. depending on the target aspect to obtain.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SYMBOLS

1 Installation for adjusting and cooling the coating of a high-thickness coated metal strip
2 Strip
3 Water cooling header
4 Gas cooling header
4' Cooling header after top roll (gas and/or water)
5 Wiping device
6 Nozzle of the water cooling header
10 Liquid metal bath
11 Sink roll
12 Upper deflection roll

The invention claimed is:

1. An installation for adjusting a thickness of a hot liquid coating on a traveling strip with suppression of "angel wing" flow defects, the traveling strip having a thickness equal to or greater than 2 mm, and for cooling the coating, the coating thickness being in a range above 25 μm, the installation successively comprising, from a bottom upwards, on either side of the traveling strip;

a wiping device comprising gas knives configured to wipe excess liquid from the coated strip at an outlet of a liquid bath;

at least one conventional gas cooling header with gas blowers configured to solidify the coating; and a water cooling and freezing header configured to produce airless spraying of demineralized water for skin freezing of the coating, the header being located as close as possible to the wiping device and between the wiping device and the at least one conventional gas cooling header, the water cooling and freezing header comprising one or more spraying nozzles, the one or more spraying nozzles being at a distance of between 50 and 300 mm from the traveling strip in use, the water cooling and freezing header being configured to spray water droplets with a size between 50 and 500 μm, with a water flow at a pressure of between 2 and 5 bar being between 0.1 and 5 $m^3/h$, so as to increase a viscosity of an external surface or skin of the liquid coating, and not an entire bulk thickness thereof, before coating solidification is completed in the at least one conventional gas cooling header.

2. The installation of claim 1, wherein the one or more spraying nozzles are provided on at least a transverse ramp.

3. The installation of claim 1, wherein the water cooling and freezing header is configured to spray water droplets in a size range between 100 and 300 μm.

4. The installation of claim 1, wherein the one or more spraying nozzles are at a distance between 100 and 200 mm from the traveling strip in use.

5. The installation of claim 1, wherein the water cooling and freezing header is configured to deliver a water flow at a pressure between 2 and 5 bar between 0.1 and 1 $m^3/h$ per meter of width of strip.

6. The installation of claim 1, wherein an excess of water sprayed on the liquid coating is collected by mechanical collectors located at a top and/or a bottom of the water cooling and freezing header.

7. The installation of claim 1, wherein a length of the water cooling and freezing header is smaller than two meters.

8. The installation of claim 7, wherein the length of the water cooling and freezing header is about one meter.

9. The installation of claim 1, wherein the water cooling and freezing header is configured so that the one or more spraying nozzles are distributed in use along a whole width of the traveling strip.

10. The installation of claim 1, wherein the water cooling and freezing header includes a casing comprising stainless steel and is provided with hoses and fast connections resistant to hot conditions.

11. The installation of claim 1, wherein the water cooling and freezing header is located between 1 and 3 meters after the gas knives.

12. The installation of claim 1, wherein the water cooling and freezing header is comprises a box configured to slide along a common vertical movement of approximately 1500 mm to adapt a position of the water cooling and freezing header to an exact position of the air knives.

13. The installation of claim 1, wherein the one or more spraying nozzles comprise overlapping flat nozzles.

14. The installation of claim 1, wherein the traveling strip comprises a metal strip dip-coated in a bath of liquid metal.

15. A coating control process for adjusting a thickness of a hot liquid coating on a traveling strip, and for cooling the coating using the installation of claim 1, the coating control process comprising, successively:

blowing a gas with the wiping device onto a surface of the traveling strip coated with the liquid coating so as to adjust the coating thickness to between 25 μm and 60 μm;

airless spraying droplets of water with the water cooling and freezing header onto the surface of a traveling strip having the liquid coating with a controlled thickness between 25 μm and 60 μm so as to increase the viscosity of a external surface or skin of the liquid coating, and not the entire bulk thickness thereof, so as to provide a coated traveling strip; and passing thereafter the coated traveling strip in the at least one conventional gas cooling header so as to perform complete solidification of the coating through its thickness, wherein a size of the sprayed water droplets is between 50 and 500 μm, and wherein the water flow at a pressure between 2 and 5 bar is between 0.1 and 5 $m^3/h$ per meter of width of the traveling strip, and the one or more spraying nozzles are at a distance between 50 and 300 mm from the traveling strip.

16. The process of claim 15, wherein the water cooling and freezing header is configured to provide a demineralized water flow adjusted according to the strip speed and/or other process parameters.

17. The process of claim 15, wherein the coating having a thickness between 15 and 60 μm comprises Pb- and Sb-free zinc-aluminium alloy.

18. The process of claim 15, wherein the traveling strip comprises a metal strip dip-coated in a bath of liquid metal.

19. The process of claim 15, wherein the size of the sprayed water droplets is between 100 and 300 μm.

20. The process of claim 15, wherein the water flow at a pressure between 2 and 5 bar is between 0.1 to 1 $m^3/h$ per meter of width of the traveling strip, and the one or more spraying nozzles are at a distance between 100 and 200 mm from the traveling strip.

* * * * *